US008518194B2

(12) United States Patent
Katter et al.

(10) Patent No.: US 8,518,194 B2
(45) **Date of Patent: *Aug. 27, 2013**

(54) MAGNETIC ARTICLE AND METHOD FOR PRODUCING A MAGNETIC ARTICLE

(75) Inventors: Matthias Katter, Alzenau (DE); Joachim Gerster, Alzenau (DE); Ottmar Roth, Gruendau (DE)

(73) Assignee: Vacuumschmelze GmbH & Co. KG, Hanau (DE)

( * ) Notice: Subject to any disclaimer, the term of this patent is extended or adjusted under 35 U.S.C. 154(b) by 114 days.

This patent is subject to a terminal disclaimer.

(21) Appl. No.: 12/809,152

(22) PCT Filed: Sep. 30, 2009

(86) PCT No.: PCT/IB2009/054265

§ 371 (c)(1),
(2), (4) Date: Jun. 18, 2010

(87) PCT Pub. No.: WO2010/038194

PCT Pub. Date: Apr. 8, 2010

(65) Prior Publication Data

US 2011/0001594 A1 Jan. 6, 2011

(30) Foreign Application Priority Data

Oct. 1, 2008 (GB) ..... 0817924.4

(51) Int. Cl.
*C22C 38/00* (2006.01)
*C21D 8/00* (2006.01)

(52) U.S. Cl.
USPC ..... 148/579; 148/101; 148/103; 420/83

(58) Field of Classification Search
USPC ..... 148/579, 101, 103; 420/83
See application file for complete search history.

(56) References Cited

U.S. PATENT DOCUMENTS 428,057 A 5/1890 Tesla
3,841,107 A 10/1974 Clark (Continued)

FOREIGN PATENT DOCUMENTS

DE 103 38 467 A1 3/2004
DE 10330574 6/2004

(Continued)

OTHER PUBLICATIONS

Fujita, Asaya et al., "Giant Volume Magnetostriction Due to the Itinerant Electron Metamagnetic Transition in $La(Fe\text{-}Si)_{13}$ Compounds," Department of Materials Science, Graduate School of Engineering, IEEE Transactions on Magnetics, vol. 35, No. 5, Sep. 1999 (pp. 3796-3798).

(Continued)

*Primary Examiner* — Jie Yang
(74) *Attorney, Agent, or Firm* — Buchanan Ingersoll & Rooney PC

(57) ABSTRACT

A magnetic article comprises, in total, elements in amounts capable of providing at least one $(La_{1-a}M_a)(Fe_{1-b-c}T_bY_c)_{13-d}X_e$ phase and less than 0.5 Vol % impurities, wherein $0 \leqq a \leqq 0.9$, $0 \leqq b \leqq 0.2$, $0.05 \leqq c \leqq 0.2$, $-1 \leqq d \leqq +1$, $0 \leqq e \leqq 3$, M is one or more of the elements Ce, Pr and Nd, T is one or more of the elements Co, Ni, Mn and Cr, Y is one or more of the elements Si, Al, As, Ga, Ge, Sn and Sb and X is one or more of the elements H, B, C, N, Li and Be. The magnetic article comprises a permanent magnet.

19 Claims, 9 Drawing Sheets

(56) References Cited

U.S. PATENT DOCUMENTS

| | | | | |
|---|---|---|---|---|
| 4,112,699 | A | 9/1978 | Hudson, III et al. | |
| 4,322,257 | A | 3/1982 | Menth et al. | |
| 4,332,135 | A | 6/1982 | Barclay et al. | |
| 4,849,017 | A | 7/1989 | Sahashi et al. | |
| 6,446,441 | B1 | 9/2002 | Dean | |
| 6,588,215 | B1 | 7/2003 | Ghoshal | |
| 6,676,772 | B2 | 1/2004 | Saito et al. | |
| 6,826,915 | B2 | 12/2004 | Wada et al. | |
| 7,063,754 | B2 | 6/2006 | Fukamichi et al. | |
| 7,076,959 | B2 | 7/2006 | Lewis | |
| 7,168,255 | B2 | 1/2007 | Saito et al. | |
| 7,670,443 | B2 | 3/2010 | Kogure et al. | |
| 7,695,574 | B2 | 4/2010 | Nakajima | |
| 7,914,628 | B2 | 3/2011 | Tsuji et al. | |
| 8,037,692 | B2 | 10/2011 | Muller et al. | |
| 2003/0051774 | A1 * | 3/2003 | Saito et al. | 148/302 |
| 2004/0079446 | A1 | 4/2004 | Kogure et al. | |
| 2004/0093877 | A1 | 5/2004 | Wada et al. | |
| 2004/0182086 | A1 | 9/2004 | Chiang et al. | |
| 2004/0194855 | A1 | 10/2004 | Fukamichi et al. | |
| 2004/0261420 | A1 | 12/2004 | Lewis | |
| 2005/0172643 | A1 | 8/2005 | Lewis | |
| 2006/0005898 | A1 | 1/2006 | Liu et al. | |
| 2006/0076084 | A1 | 4/2006 | Nakajima | |
| 2006/0213580 | A1 | 9/2006 | Tsuji et al. | |
| 2006/0218936 | A1 | 10/2006 | Kobayashi et al. | |
| 2006/0231163 | A1 | 10/2006 | Hirosawa et al. | |
| 2007/0137732 | A1 | 6/2007 | Kogure et al. | |
| 2007/0218319 | A1 | 9/2007 | Ohkoshi et al. | |
| 2007/0220901 | A1 | 9/2007 | Kobayashi et al. | |
| 2008/0078184 | A1 | 4/2008 | Saito et al. | |
| 2008/0078476 | A1 | 4/2008 | Saito et al. | |
| 2010/0037625 | A1 | 2/2010 | Katter | |
| 2010/0047527 | A1 | 2/2010 | Katter | |
| 2010/0116471 | A1 | 5/2010 | Reppel et al. | |
| 2010/0129794 | A1 | 5/2010 | Fabis et al. | |
| 2011/0048690 | A1 | 3/2011 | Reppel et al. | |
| 2011/0140031 | A1 | 6/2011 | Katter et al. | |
| 2011/0151230 | A1 | 6/2011 | Katter | |
| 2011/0168363 | A9 | 7/2011 | Reppel et al. | |
| 2011/0198069 | A1 | 8/2011 | Katter et al. | |

FOREIGN PATENT DOCUMENTS

| | | | |
|---|---|---|---|
| DE | 10 2006 015 370 | A1 | 10/2006 |
| DE | 112007003401 | | 1/2010 |
| EP | 0 187 538 | A2 | 7/1986 |
| EP | 0 217 347 | B1 | 2/1993 |
| EP | 1 867 744 | A1 | 12/2007 |
| EP | 1 463 068 | B1 | 2/2009 |
| GB | 1076036 | | 7/1967 |
| GB | 2 424 901 | A | 10/2006 |
| GB | 2 458 039 | A | 9/2009 |
| GB | 2 459 066 | A | 10/2009 |
| GB | 2 460 774 | A | 12/2009 |
| JP | 60204852 | A | 10/1985 |
| JP | 62243377 | A | 10/1987 |
| JP | 63-055906 | | 3/1988 |
| JP | 02-190402 | | 7/1990 |
| JP | 4-338604 | A | 11/1992 |
| JP | 4-338605 | A | 11/1992 |
| JP | 7-320918 | A | 12/1995 |
| JP | 2000-54086 | | 2/2000 |
| JP | 2000-274976 | A | 10/2000 |
| JP | 2002-69596 | | 3/2002 |
| JP | 2002-356748 | A | 12/2002 |
| JP | 2003-28532 | A | 1/2003 |
| JP | 2005-036302 | A | 2/2005 |
| JP | 2005-93729 | | 4/2005 |
| JP | 2005-113209 | | 4/2005 |
| JP | 2005-120391 | A | 5/2005 |
| JP | 2006-89839 | A | 4/2006 |
| JP | 2006124683 | A | 5/2006 |
| JP | 2006-283074 | A | 10/2006 |
| JP | 2007-031831 | A | 2/2007 |
| JP | 2007-084897 | A | 4/2007 |
| JP | 2007-281410 | A | 10/2007 |
| JP | 2007291437 | A | 11/2007 |
| JP | 2005-226125 | | 8/2008 |
| JP | 2009-249702 | A | 10/2009 |
| WO | WO 93/25857 | | 12/1993 |
| WO | WO 00/45397 | A1 | 8/2000 |
| WO | WO 2004/019379 | A2 | 3/2004 |
| WO | WO 2005/066980 | A2 | 7/2005 |
| WO | WO 2006/074790 | A1 | 7/2006 |
| WO | WO 2007/026062 | A1 | 3/2007 |
| WO | WO 2007/065933 | A1 | 6/2007 |
| WO | WO 2008/099234 | * | 8/2008 |
| WO | WO 2008/099234 | A9 | 8/2008 |
| WO | WO 2008/099235 | A1 | 8/2008 |
| WO | WO 2009/090442 | A1 | 7/2009 |
| WO | WO 2010/038098 | A1 | 4/2010 |
| WO | WO 2010/128357 | A1 | 11/2010 |

OTHER PUBLICATIONS

Katter, Matthias et al., "Magnetocaloric Properties of La(Fe, Co, Si)$_{13}$ Bulk Material Prepared by Powder Metallurgy," Vacuumschmelze GmbH and Company KG, IEEE Transactions on Magnetics, vol. 44, No. 11, Nov. 2008 (pp. 3044-3047).

Kneller, E., "Ferromagnetismus," Springer-Verlag, 1962 (1 page).

Massalski, Th.B., "Diagram 1074," Binary Alloy Phase Diagrams, Ed. J.L. Murray, L.H. Benett, H. Backer, American Society of Metals Ohio, (1986) 1074.

Massalski, Th.B., "Diagram 1108," Binary Alloy Phase Diagrams, Ed. J.L. Murray, L.H. Benett, H. Backer, American Society of Metals Ohio, (1986) 1108.

Saito, A. T. et al., "Magnetocaloric Effect of New Spherical Magnetic Refrigerant Particles of La($Fe_{1-x-y}Co_xSi_y$)$_{13}$ Compounds," ScienceDirect, Journal of Magnetism and Magnetic Materials 310 (2007) 2808-2810, www.sciencedirect.com (pp. 2808-2810).

Villars, P. et al., "Diagram 8502," Handbook of Ternary Alloy Phase Diagrams, 2$^{nd}$ Ed., ASM International, 7 (1997) 8502 (1 page).

Villars, P. et al., "Diagram 10375," Handbook of Ternary Alloy Phase Diagrams, 2$^{nd}$ Ed., ASM International, 10 (1997) 10375 (1 page).

Zhang, Hong-wei et al., "The Spike in the Relation Between Entropy Change and Temperature in $LaFe_{11.83}Si_{1.17}$ Compound," ScienceDirect, Journal of Magnetism and Magnetic Materials 320 (2008) 1879-1883, www.sciencedirect.com (pp. 1879-1883).

Barrett, C.S., "Crystal Structure of Metals," ASM Handbook, Formerly Ninth Edition, Metals Handbook, vol. 9, ASM International, Materials Park, OH (1985), pp. 8-9.

Chang, H. et al., "Theoretical Study of Phase Forming of $NaZn_{13}$-type Rare-Earth Intermetallics," *J. Phys.: Condens. Matter*, vol. 15 (2003) pp. 109-120 XP002385787.

Fujieda, S. et al., "Enhancement of Magnetocaloric Effects in $La_{1-z}Pr_z(Fe_{0.88}Si_{0.12})_{13}$ and their Hydrides," *Journal of Applied Physics* 102, 023907 (2007) American Institute of Physics (5 pages).

Fujieda, S. et al., "Giant Isotropic Magnetostriction of Itinerant-Electron Metamagnetic $La(Fe_{0.88}Si_{0.12})_{13}H_y$ Compounds," Applied Physics Letters, vol. 79, No. 5, Jul. 30, 2001, pp. 653-655.

Fujieda, S. et al., "Large Magnetocaloric Effect in $La(Fe_xSi_{1-x})_{13}$ Itinerant-Electron Metamagnetic Compounds," *Applied Physics Letters*, vol. 81, No. 7, Aug. 12, 2002, American Institute of Physics (2002) pp. 1276-1278.

Fujieda, S. et al., "Strong Magnetocaloric Effects in $La_{1-z}Ce_z(Fe_{x-y}Mn_ySi_{1-x})_{13}$ at Low Temperatures," *Applied Physics Letters*, vol. 89, 062504 (2006) American Institute of Physics (3 pages).

Fujita, A. et al., "Control of Large Magnetocaloric Effects in Metamagnetic $La(Fe_xSi_{1-x})_{13}$ Compounds by Hydrogenation," *Journal of Alloys and Compounds* 404-406 (2005) pp. 554-558, Elsevier B.V. (5 pages).

Fujita, A. et al., "Giant Magnetovolume and Magentocaloric Effects in Itinerant-Electron Metamagnetic $La(Fe_xSi_{1-x})_{13}$ Compounds," *Materia Japan*, vol. 41, No. 4, Apr. 20, 2002, pp. 269-275.

Hu, F. X. et al., "Magnetic Entropy Change in La $(Fe_{0.98}Co_{0.02})_{11.7}Al_{1.3}$," *J. Phys.: Condens. Matter*, vol. 12 (2000) L691-696.

Hu, F. X. et al., "Magnetic Entropy Change and its Temperature Variation in Compounds $La(Fe_{1-x}Co_x)_{11.2}Si_{1.8}$," *Journal of Applied Physics*, vol. 92, No. 7, Oct. 1, 2002, American Institute of Physics (2002) pp. 3620-3623.

Ji, J. F. et al., "A Novel Technique for Manufacturing Metal-bonded Nd-Fe-B Magnets by Squeeze Casting," *Metallurgical and Materials Transactions A* (Physical Metallurgy and Material Science) ISSN 1073-5623, 2002, vol. 33, No. 3, pp. 637-646 (10p.) and Abstract of the same.
Mandal, K. et al., "Magnetocaloric Effect in Reactively-Milled LaFe11.57Si1.43Hy Intermetallic Compounds," Journal of Applied Physics 102, 053906 (2007) American Institute of Physics (5 pages).
Otani, Y. et al., "Metal Bonded $Sm_2Fe_{17}N_{3-\delta}$ magnets," Department of Pure and Applied Physics, Trinity College, Dublin 2, Ireland, *J. Appl. Phys.* 69 (9), May 1, 1991, 1991 American Institute of Physics, pp. 6735-6737.
Richard, M.A. et al., "Magnetic Refrigeration: Single and Multimaterial active Magnetic Regenerator Experiments," *Journal of Applied Physics*, vol. 95, No. 4, Feb. 15, 2004, pp. 2146-2150, American Institute of Physics (6 pages).
Tishin, A.M. et al., "The Magnetocaloric Effect and its Applications," Institute of Physics Publishing, Bristol and Philadelphia, IOP Publishing Ltd. 2003, pp. 371-375.
Wang, J. et al., "The Hydrogenation Behavior of LaFe11.44Si1.56 Magnetic Refrigerating Alloy," Journal of Alloys and Compounds, vol. 485 (2009) pp. 313-315, Elsevier B.V. (3 pages).
Zhang, X. X. et al., "Magnetic Entropy Change in Fe-based Compound $LaFe_{10.6}Si_{2.4}$," Applied Physics Letters, vol. 77, No. 19, Nov. 16, 2000, pp. 3072-3074 (2000) American Institute of Physics.
Zimm, C. et al., "Description and Performance of a Near-Room Temperature Magnetic Refrigerator," *Advances in Cryogenic Engineering*, vol. 43, Plenum Press, New York, (1998) pp. 1759-1766.
Form PCT/IB/326; Form PCT/IB/373 and Form PCT/ISA/237 corresponding to PCT/IB/ 2009/051854 dated Nov. 17, 2011.
Notice of Reasons for Rejection corresponding to JP 2010-511750 dated Sep. 13, 2011.
Examination Report under Section 18(3) corresponding to GB Application No. 1015392.2 dated Sep. 14, 2011.
Japanese Office Action corresponding to JP Patent Application No. 2010-504885 dated Nov. 1, 2011.

* cited by examiner

MAGNETIC ARTICLE AND METHOD FOR PRODUCING A MAGNETIC ARTICLE

BACKGROUND

1. Field

The present application relates to a magnetic article, in particular an article with permanent magnetic properties, and to a method for producing a magnetic article.

2. Description of Related Art

Permanent magnets can be produced from alloys based on the Al—Ni—Co and Fe—Cr—Co systems for example. These magnets have so called half-hard magnetic properties and comprise a non-magnetic matrix with finely dispersed strongly ferromagnetic inclusions.

These alloys typically comprise at least 10% Co. In recent years, the cost of cobalt has risen significantly leading to an undesirable increase in the cost of magnets fabricated from these alloys.

It is, therefore, desirable to provide alternative magnetic materials which, preferably, have reduced raw materials costs and which can be reliably worked to provide permanent magnets having a variety of forms suitable for a wide variety of applications.

SUMMARY

A magnetic material is provided comprising, in total, elements in amounts capable of providing at least one $(La_{1-a}M_a)(Fe_{1-b-c}T_bY_c)_{13-d}X_e$ phase and less than 5 Vol % impurities, wherein $0 \leqq a \leqq 0.9$, $0 \leqq b \leqq 0.2$, $0.05 \leqq c \leqq 0.2$, $-1 \leqq d \leqq +1$, $0 \leqq e \leqq 3$, M is one or more of the elements Ce, Pr and Nd, T is one or more of the elements Co, Ni, Mn and Cr, Y is one or more of the elements Si, Al, As, Ga, Ge, Sn and Sb and X is one or more of the elements H, B, C, N, Li and Be. The magnetic article comprises a permanent magnet.

A soft magnetic material is defined as a magnetic material having a coercive field strength of less than 10 Oe. A permanent magnetic material is defined as a magnetic material which is not a soft magnetic material and has a coercive field strength of 10 Oe or greater.

However, permanent magnets can be further divided into two classes. A magnetic material having a coercive field strength of greater than 600 Oe may be defined as a hard magnetic material. Magnetic material having a coercive field strength in the range of 10 Oe to 600 Oe may be defined a half-hard magnetic material.

The composition disclosed herein includes the element lanthanum, which is associated with low raw material costs due to its natural abundance. Iron is also included, and is also inexpensive. Therefore, a permanent magnet is provided with low raw materials costs.

Furthermore, the composition, when heat treated to provide a magnetic article with permanent magnetic properties, can be easily worked by machining, for example, grinding and wire erosion cutting. Therefore, a large block may be produced by cost effective methods, such as powder metallurgical techniques, and then further worked to provide a number of smaller articles having the desired dimensions for a particular application. Magnetic articles can be cost-effectively produced for a wide variety of applications from this composition.

Alloys of the above composition are also capable of being heat treated to form a phase with a $NaZn_{13}$-type crystal structure which can display a magnetocaloric effect. The composition can, however, also be heat treated to provide a magnetic article with permanent magnetic properties.

In an embodiment, a precursor article comprising at least one magnetocalorically active phase with a $NaZn_{13}$-type crystal structure is heat treated so as to produce a permanent magnet. The present application therefore also relates to the use of a magnetocalorically active phase comprising a $NaZn_{13}$-type crystal structure to produce a permanent magnet.

As used herein, magnetocalorically active is defined as a material which undergoes a change in entropy when it is subjected to a magnetic field. The entropy change may be the result of a change from ferromagnetic to paramagnetic behaviour, for example. The magnetocalorically active material may exhibit, in only a part of a temperature region, an inflection point at which the sign of the second derivative of magnetization with respect to an applied magnetic field changes from positive to negative.

In further embodiments, the magnetic article comprises the following magnetic properties: $B_r > 0.35$ T and $H_{cJ} > 80$ Oe and/or $B_s > 1.0$ T.

In an embodiment, the magnetic article comprises a composition, in total, in which a=0, T is Co and Y is Si and e=0 and in a further embodiment $0 < b \leqq 0.075$ and $0.05 < c \leqq 0.1$ when a=0, T is Co and Y is Si and e=0.

The magnetic article may comprise at least one α-Fe-type phase. In a further embodiment, the magnetic article comprises greater than 60 vol % of one or more α-Fe-type phases. The α-Fe-type phase may further comprise Co and Si.

In an embodiment, the magnetic article further comprises La-rich and Si-rich phases.

The magnetic article may comprise a composite structure comprising a non-magnetic matrix and a plurality of permanently magnetic inclusions distributed in the non-magnetic matrix. As used herein, non-magnetic refers to the condition of the matrix at room temperature and includes paramagnetic and diamagnetic materials as well as ferromagnetic materials with a very small saturation polarization. The magnetic article may have half hard magnetic properties.

The permanent magnetic inclusions may be strongly ferromagnetic and may comprise an α-Fe-type phase or a plurality of α-Fe-type phases of differing composition.

In a further embodiment, the magnetic article comprises anisotropic magnetic properties.

Methods for producing a magnetic article are also provided. In an embodiment, a precursor article comprising, in total, elements in amounts capable of providing at least one $(La_{1-a}M_a)(Fe_{1-b-c}T_bY_c)_{13-d}X_e$ phase and less than 5 Vol % impurities is provided, wherein $0 \leqq a \leqq 0.9$, $0 \leqq b \leqq 0.2$, $0.05 \leqq c \leqq 0.2$, $-1 \leqq d \leqq +1$, $0 \leqq e \leqq 3$, M is one or more of the elements Ce, Pr and Nd, T is one or more of the elements Co, Ni, Mn and Cr, Y is one or more of the elements Si, Al, As, Ga, Ge, Sn and Sb and X is one or more of the elements H, B, C, N, Li and Be. The precursor article is then heat treated to produce an article with permanent magnetic properties.

The precursor article may be self-supporting. For example, the precursor article may be provided in the form of a block, a plate, or tape. The precursor article may also be provided in the form of powder or flakes.

The heat treatment conditions are selected so as to produce a magnetic article with permanent magnetic properties or half-hard magnetic properties. Heat treatment conditions may include temperature, dwell time, ramp rate, cooling rate, the atmosphere under which the heat treatment takes place, for example under a vacuum or a gas such as argon. The heat treatment conditions required to produce a magnetic article with a permanent magnetic properties also depend on the composition of the precursor article and its density and may be adjusted to produce the desired magnetic properties.

In an embodiment, the precursor article is heat treated under conditions selected to produce at least one permanently magnetic α-Fe-type phase.

In a further embodiment, before the heat treating, the precursor article comprises at least one phase with a $NaZn_{13}$-type crystal structure. This phase may also be magnetocalorically active.

If the precursor article comprises at least one phase with a $NaZn_{13}$-type crystal structure, the precursor article may be heat treated under conditions selected so as to decompose the phase with the $NaZn_{13}$-type crystal structure and form at least one permanent magnetic phase.

The heat treatment conditions may also be selected to produce permanent magnetic inclusions in a non-magnetic matrix and/or to produce an article that comprises a permanently magnetic portion of at least 60 vol %.

In further embodiments, the precursor article and/or the permanent magnet is heated treated whilst applying a magnetic field to produce an anisotropic permanent magnet. The magnetic field may be applied during the heat treatment to form the permanent magnet. Alternatively, or in addition, the permanent magnet may be subjected to a further heat treatment while applying the magnetic field.

In an embodiment, the precursor article is produced by mixing powders selected to provide, in total, elements in amounts capable of providing at least one $(La_{1-a}M_a)(Fe_{1-b-c}T_bY_c)_{13-d}X_e$ phase and sintering the powders at a temperature T1 to produce at least one phase with a $NaZn_{13}$-type crystal structure. This phase may be magnetocalorically active.

After the heat treatment at temperature T1 to produce at least one phase with a $NaZn_{13}$-type crystal structure, the article may be further heat treated at a temperature T2 to form at least one permanent magnetic phase, wherein T2<T1. The phase displaying permanent magnetic properties is formed at a lower temperature and the temperature required to form the phase or phases with the $NaZn_{13}$-type crystal structure.

In an embodiment, the article is cooled from T1 to T2 at a rate of greater than 2 K/min or, preferably, greater than 10 K/min.

The temperature T2 may be selected so as to produce a decomposition of the phase with the $NaZn_{13}$-type crystal structure at T2. The phase with permanent magnetic properties may form as a consequence of the decomposition of the phase with the $NaZn_{13}$-type crystal structure.

In a further embodiment, the composition of the precursor article is selected so as to produce a reversible decomposition of the phase with the $NaZn_{13}$-type crystal structure at the temperature T2. After decomposition of the phase with the $NaZn_{13}$-crystal structure at T2, the phase with the $NaZn_{13}$-type crystal structure may be reformable at a temperature T3, wherein T3 is greater than T2.

BRIEF DESCRIPTION OF DRAWINGS

Embodiments will now be described with reference to the accompanying drawings, which are not intended to be limiting, but to aid in understanding the embodiments disclosed herein.

DETAILED DESCRIPTION OF SPECIFIC EMBODIMENTS

Figure 1:
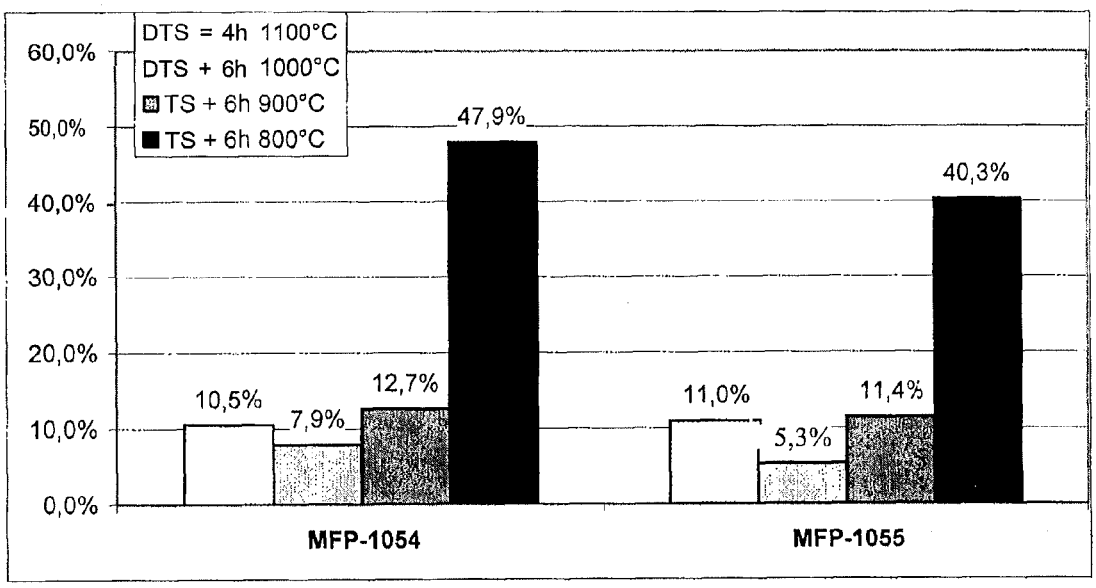
FIG. 1 is a graph that illustrates the effect of temperature on α-Fe content for a precursor article fabricated by sintering at 1100° C.

In a first set of experiments, three different compositions were investigated for the fabrication of magnetic articles having permanent magnetic or half hard magnetic properties. Compositions comprising, in total, elements in amounts capable of providing at least one $La(Fe_{1-b-c}Co_bSi_c)_{13-d}X_e$ phase were investigated.

The α-Fe content was measured using a thermomagnetic method in which the magnetic polarization of a sample heated above its Curie Temperature is measured as the function of temperature of the sample when it is placed in an external magnetic field. The Curie temperature of a mixture of several ferromagnetic phases can be determined and the proportion of α-Fe determined by use of the Curie-Weiss law.

In particular, thermally insulated samples of around 20 g are heated to a temperature of around 400° C. and placed in a Helmholz-coil which is situated in an external magnetic field of around 5.2 kOe produced by a permanent magnet. The induced magnetic flux is measured as a function of temperature as the sample cools.

Embodiment 1

A powder mixture comprising 18.55 wt % lanthanum, 3.6 wt % silicon, 4.62 wt % cobalt, balance iron was milled under protective gas to produce an average particle size of 3.5 μm (F. S. S. S.). The powder mixture was pressed under a pressure of 4 t/cm$^2$ to form a block and sintered at 1080° C. for 8 hours. The sintered block had a density of 7.24 g/cm$^3$. The block was then heated at 1100° C. for 4 hours and 1050° C. for 4 hours and rapidly cooled at 50 K/min to provide a precursor article. The precursor article comprised around 4.7% of α-Fe phases, see MPS 1037 in FIG. 6.

The precursor article was then heated for a total of 32 hours at temperatures from 1000° C. to 650° C. in 50° C. steps to produce a magnetic article with permanent magnetic properties. The dwell time at each temperature was 4 hours. After this heat treatment, the block comprised 67.2 percent of α-Fe phases.

The magnetic properties of the block were measured. The coercive field strength $H_{cJ}$ of the block was 81 Oe, the remanence 0.39 T and the saturation magnetization was 1.2 T, see FIG. 8.

Embodiment 2

A powder mixture comprising 18.39 wt % lanthanum, 3.42 wt % silicon, 7.65 wt % cobalt, balance iron was milled under protective gas, pressed to form a block and sintered at 1080° C. for 4 hours to produce a precursor article.

The precursor article was then heated at 750° C. for 16 hours to produce a permanent magnet. After this heat treatment was observed to have an α-Fe content of greater than 70%.

A second precursor article produced from this powder batch was heated at a temperature of 650° C. A dwell time of 80 hours at 650° C. produced an α-Fe content of greater than 70%.

Embodiment 3

A powder mixture comprising 18.29 wt % lanthanum, 3.29 wt % silicon, 9.68 wt % cobalt, balance iron was milled under protective gas, pressed to form a block and sintered at 1080° C. for 4 hours to produce a precursor article.

The precursor article was then heated at 750° C. A dwell time of 80 hours was required to produce an α-Fe content of greater than 70%.

From a comparison of Embodiments 2 and 3, the temperature and dwell time required to produce a magnetic article with an α-Fe content of greater than 70% may depend on the total composition of the precursor article.

A magnetic article may be expected to have increasingly better permanent magnetic properties for increasing α-Fe contents. The effect of the heat treatment conditions on the measured α-Fe content was investigated further in the following embodiments.

Effect of Heat Treatment Temperature on α-Fe Content

The effect of temperature on α-Fe content was investigated for precursor articles fabricated using the powder mixture of embodiments 2 and 3 above. The results are summarized in FIGS. 1 to 5.

Powder mixtures of embodiments 2 and 3 were pressed to form blocks and sintered at three different temperatures 1100° C., 1080° C. and 1060° for 4 hours, the first 3 hours in vacuum and the fourth hour in argon to produce precursor articles.

A precursor article of each composition sintered at each of the three temperatures was then heated for 6 hours in argon at 1000° C., 900° C. or 800° C. and the α-Fe content measured. The results are summarised in FIGS. 1 to 3.

The α-Fe content was measured to be much larger after a heat treatment at a temperature of 800° C. for both compositions for all of the samples than after a heat treatment at 900° C. or 1000° C.

Figure 2:
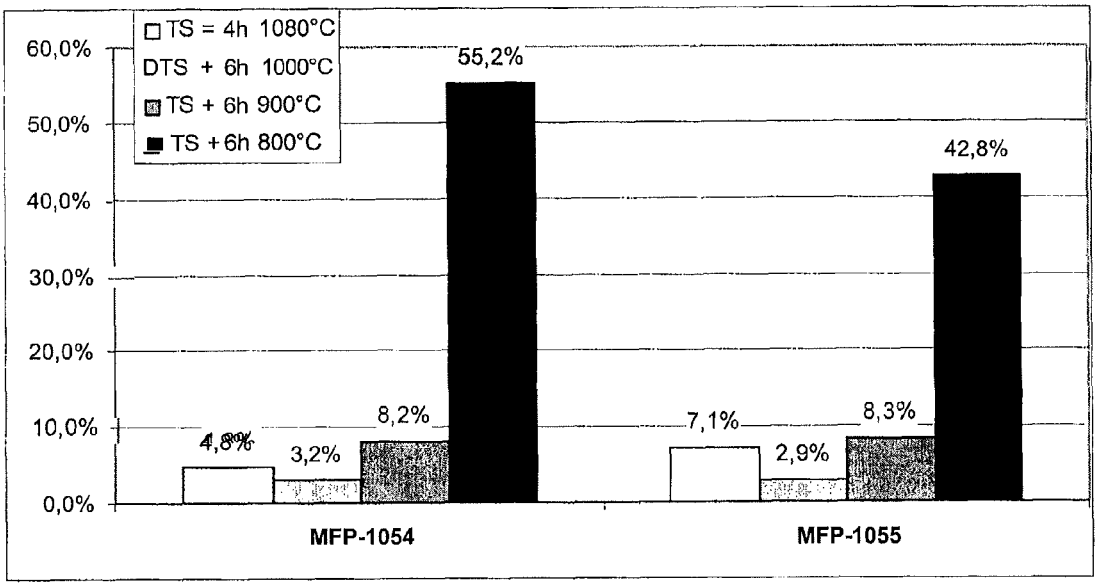
FIG. 2 is a graph that illustrates the effect of temperature on α-Fe content for a precursor article fabricated by sintering at 1080° C.
Figure 3:
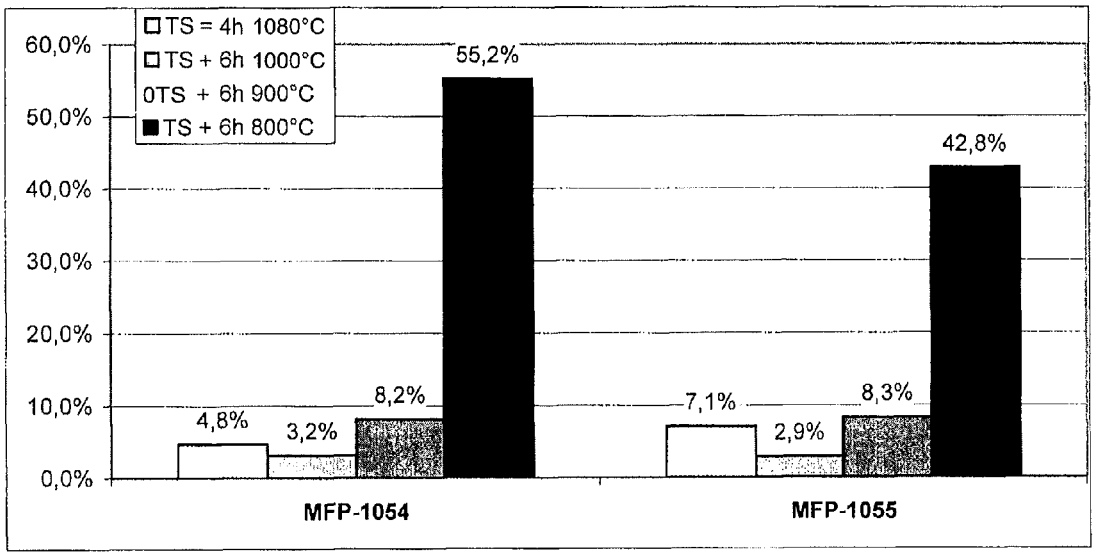
FIG. 3 is a graph that illustrates the effect of temperature on α-Fe content for a precursor article fabricated by sintering at 1060° C.
Figure 4:
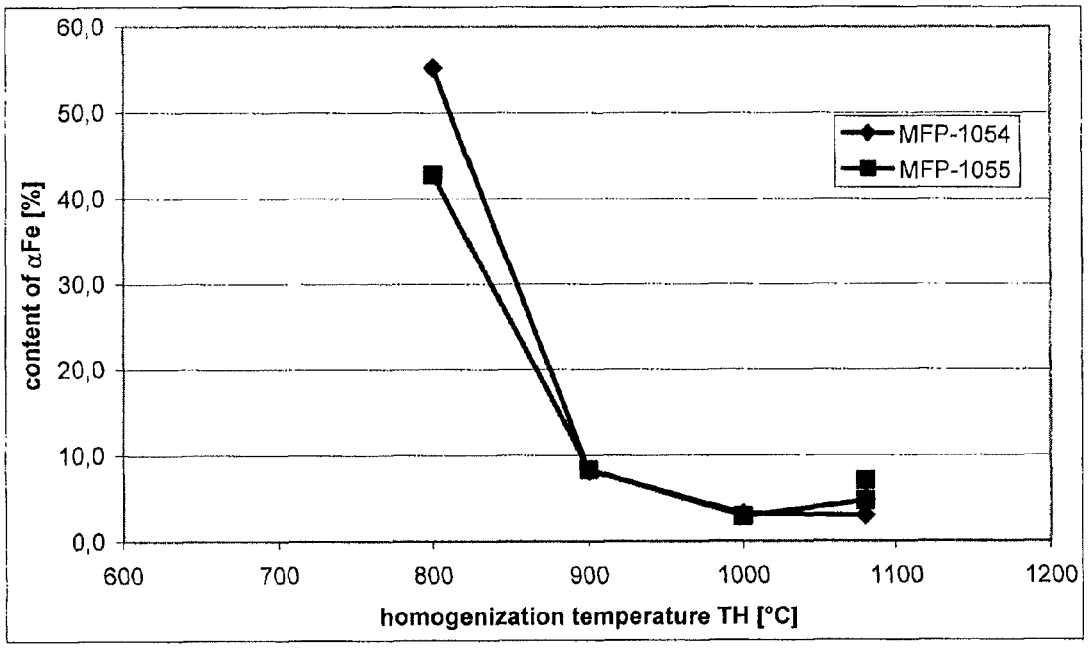
FIG. 4 is a graph that illustrates a comparison of the results of FIG. 2.

FIG. 4 illustrates a comparison of the two samples of FIG. 2 and indicates that for a given temperature, the α-Fe content obtained may depend at least in part on the composition of the sample.

Figure 5:
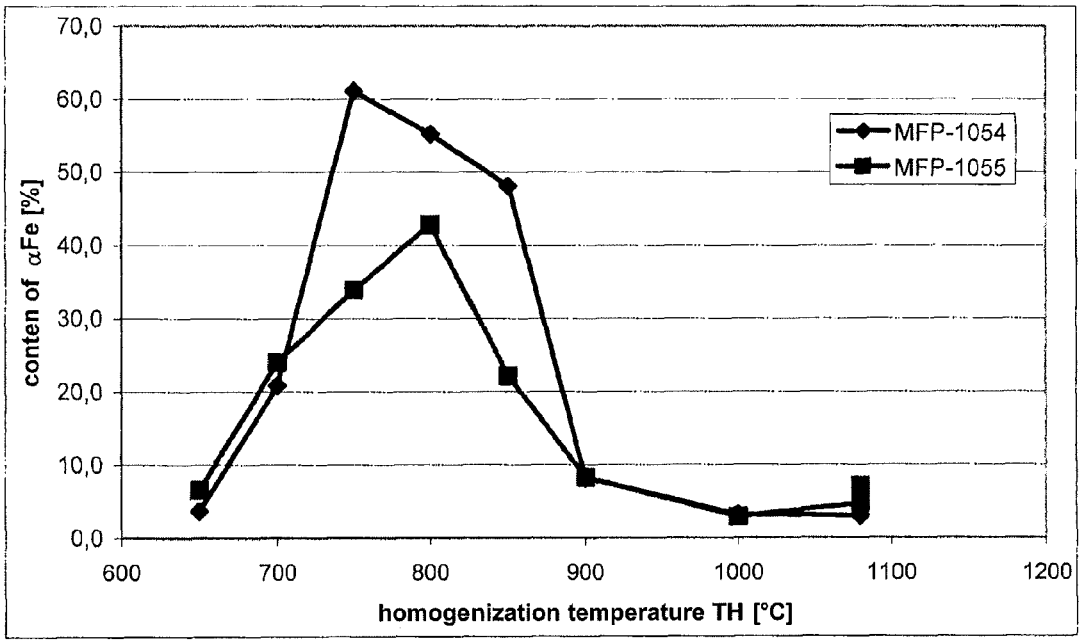
FIG. 5 is a graph that illustrates the effect of temperature on α-Fe content for a precursor article fabricated by sintering at 1080° C.

FIG. 5 illustrates a graph of α-Fe content measured for pre-sintered precursor articles having a composition corresponding to that of Embodiments 2 and 3 and heat treated at temperatures in the range 650° C. to 1080° C. to produce an article having permanent magnetic properties.

The results of these experiments indicate that, for a particular dwell time, in this embodiment, 4 hours, there is an optimum temperature range for producing a high α-Fe content as the graph for each sample has a peak.

For a heat treatment time of four hours, the maximum α-Fe was observed at 750° C. for Embodiment 2 and the maximum α-Fe observed at 800° C. for Embodiment 3. These results also indicate that the optimum heat treatment conditions to produce the highest α-Fe content depends on the composition of the precursor article.

Effect of the Heat Treatment Time on α-Fe Content

In a further set of experiments, the effect of the heat treatment time on the α-Fe content was investigated.

Sintered precursor articles comprising the composition of Embodiments 2 and 3 were heat treated at 650° C., 700° C., 750° C. and 850° C. for different times and the α-Fe content measured. The results are summarised in Tables 1 and 2.

These results indicate that, in general, the α-Fe content increases for increased heat treatment times at these temperatures.

Effect of Cooling Rate on α-Fe Content

The effect of a slow cooling rate was simulated for a second set of precursor articles sintered to produce a magnetocalorically active phase having a Curie temperature and composition as listed in Table 3.

The compositions listed in Table 3 are the so called metallic contents of the precursor articles and are therefore denoted with the subscript m. The metallic content of an element differs from the overall content of the element in that the portion of the element which is present in the article in the form of an oxide or nitride, for example $La_2O_3$ and LaN, is subtracted from the overall content to give the metallic content.

Figure 6:
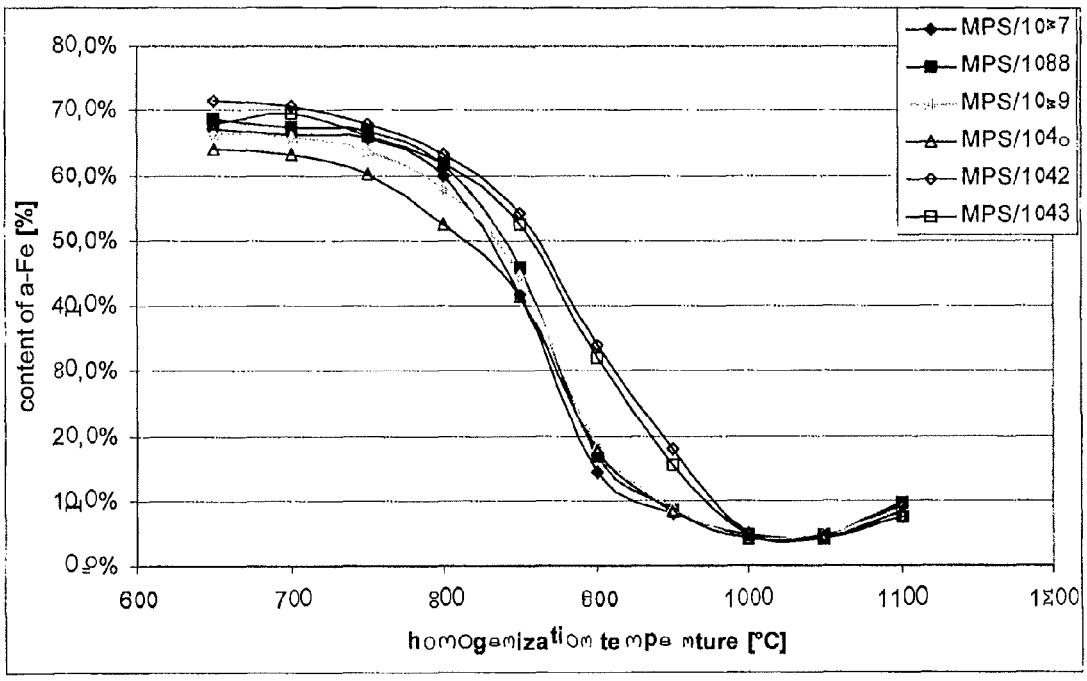
FIG. 6 is a graph that illustrates the effect of temperature on α-Fe content for precursor articles of table 3 having differing compositions, FIG. 7(*a*) is a SEM micrograph of an embodiment of a precursor article described herein, FIG. 7(*b*) is a SEM micrograph of the precursor article of FIG. 7(*a*) after heat treatment to produce a permanent magnet.

A very slow cooling rate was simulated by heating the samples at 1100 for 4 hours followed by rapid cooling to determine a starting α-Fe content. Afterwards the temperature was reduced at 50° C. intervals and the sample heated for further 4 hours at each temperature before being rapidly cooled. The α-Fe content was measured after heat treatment at each temperature. The results are illustrated in FIG. 6 and summarised in Table 4.

The α-Fe content was observed to increase for decreasing temperature for all of the samples. In contrast to the embodiment illustrated in FIG. 5, the samples with the higher cobalt content have a larger α-Fe content than those with lower cobalt contents.

Figure 7A:
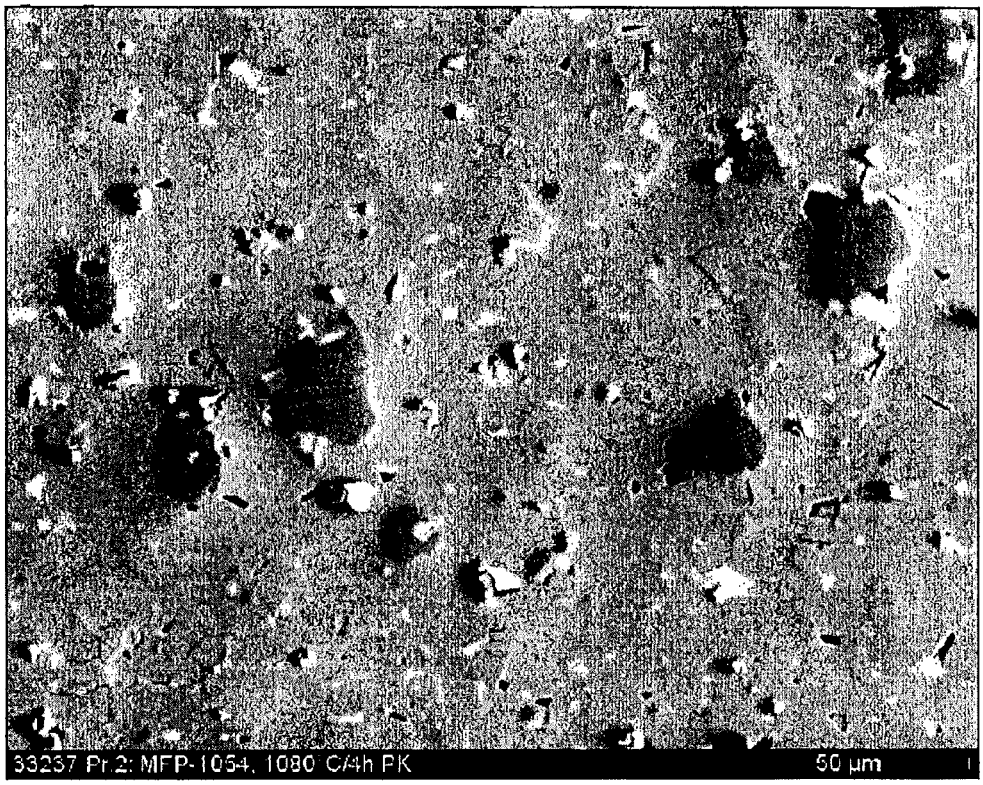

FIG. 7*a* illustrates an SEM micrograph for an embodiment of a precursor article having a composition of 3.5 wt % silicon and 8 wt % cobalt which was sintered at 1080° C. for 4 hours. This precursor article includes a $La(Fe,Si,Co)_{13}$-based phase which is magnetocalorically active.

Figure 7B:
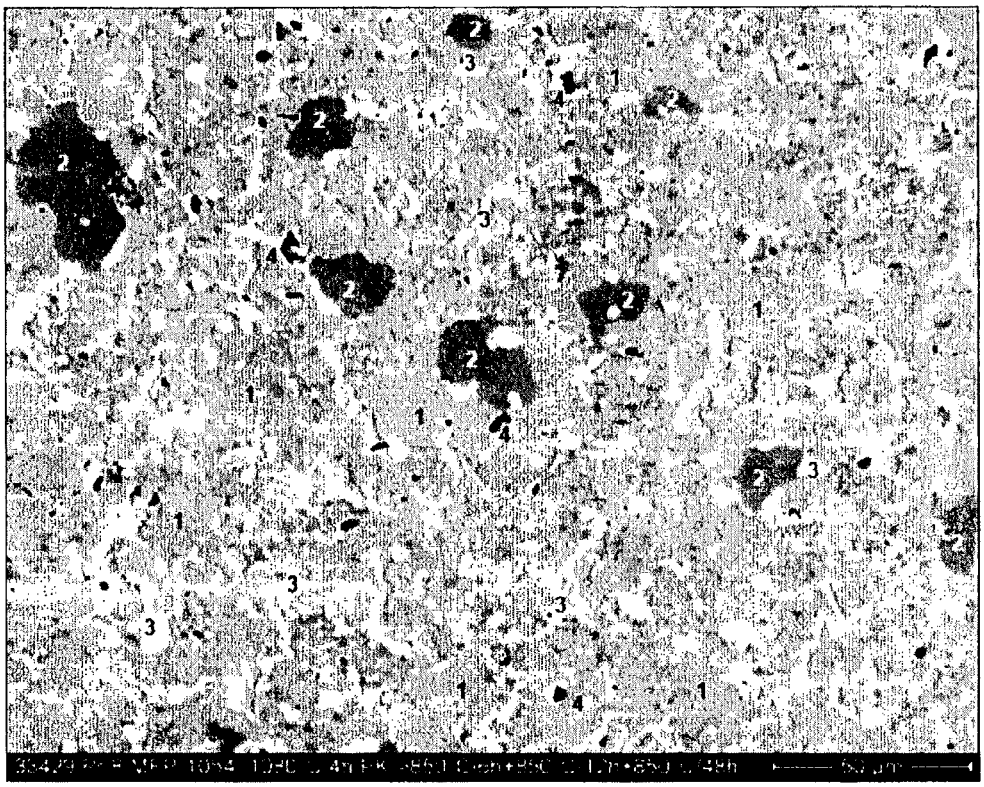

FIG. 7*b* illustrates an SEM micrograph of the block of FIG. 7*a* after it has undergone a heat treatment at 850° C. for a total of 66 hours. The block comprises a number of phases characterised by areas having a different degree of contrast in the micrograph. The light areas were measured by EDX analysis to be La-rich and the small dark areas Fe-rich.

Permanent magnets having in total elements in amounts to produce a $La(Si, Fe, Co)_{13}$-based phase having a Curie temperature can be produced with α-Fe contents of at least 60% by selecting the heat treatment conditions, such as the heat treatment temperature, dwell time and cooling rate.

The nomenclature $La(Si, Fe, Co)_{13}$ is used to indicate that the sum of the elements Si, Fe and Co is 13 for 1 La. The Si, Fe and Co content may, however, vary although the total of the three elements remains the same.

Magnetic Properties

Figure 8:
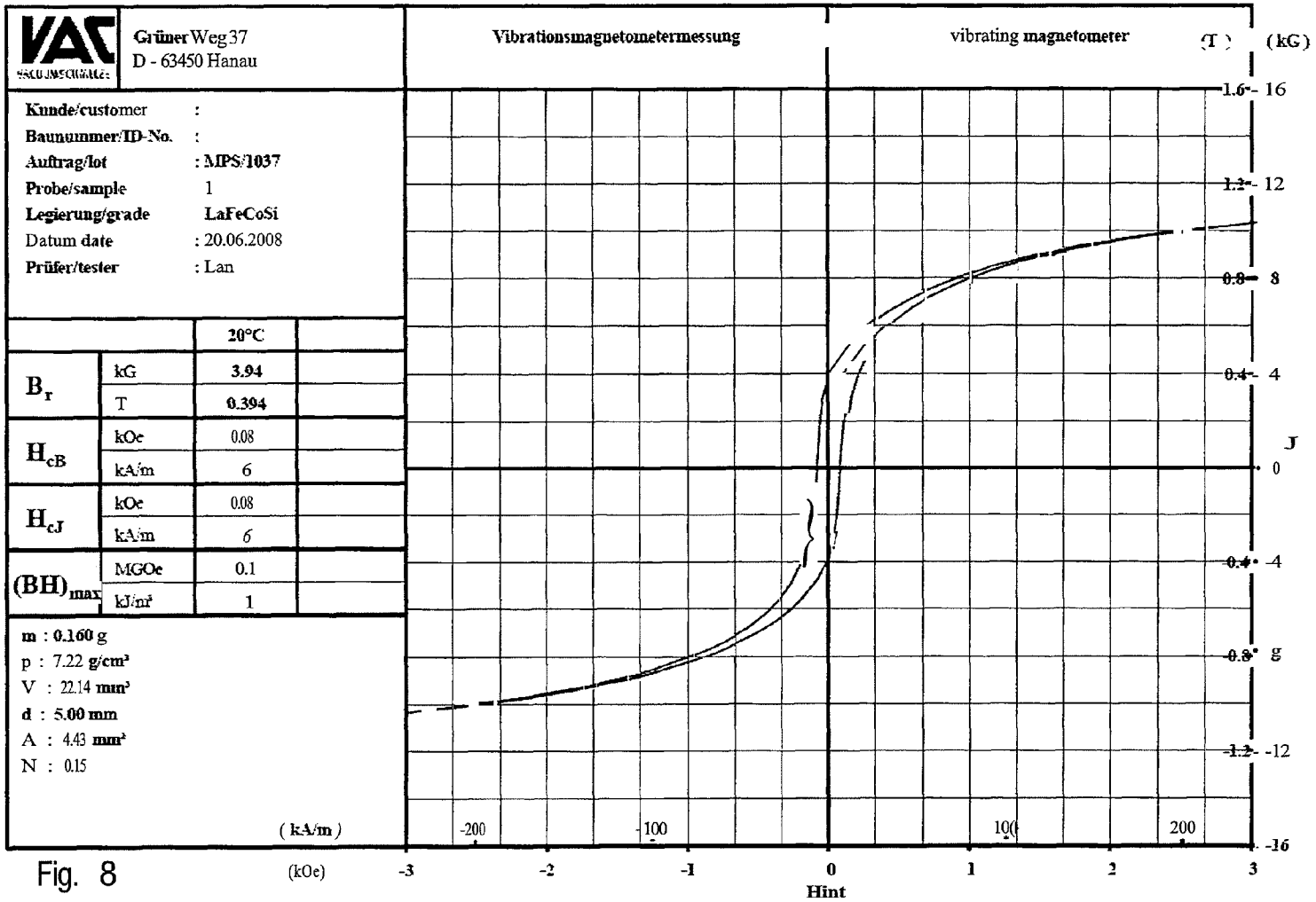
FIG. 8 is a graph showing a hysteresis loop measured for an embodiment of a permanent magnet comprising a composition in total of $La(Fe,Si,Co)_{13}$, FIG. 9(*a*) is a graph that illustrates a hysteresis loop measured for a permanent magnet comprising a composition in total of $La(Fe, Si, Co)_{13}$ according to a further embodiment, FIG. 9(*b*) is a graph that illustrates an enlarged view of the hysteresis loop of FIG. 9(*a*)

FIG. 8 illustrates a hysteresis loop of a magnet having an overall composition of $La(Fe, Si, Co)_{13}$ with 4.4 wt % cobalt which was slowly cooled from a temperature of 1100° C. to 650° C. in 40 hours and measured to have an α-Fe content of 67%. The magnetic properties measured are summarised in table 5. The sample has $B_r$ of 0.394 T, $H_{cB}$ of 0.08 kOe, $H_{cJ}$ of 0.08 kOe and $(BH)_{max}$ of 1 kJ/m$^3$.

Embodiment 4

The magnetic properties of magnets having an overall composition of $La(Fe, Si, Co)_{13}$ were investigated. In particular, three compositions with differing silicon contents were investigated. The compositions in weight percent are summarized in table 6.

Alloy 1 has a composition of 18.1 wt % La, 4.49 wt % Co, 3.54 wt % Si, 0.026 wt % C, 0.24 wt % 0, 0.025 wt % N, balance Fe. Alloy 2 has a composition of 18.1 wt % La, 4.48 wt % Co, 3.64 wt % Si, 0.025 wt % C, 0.23 wt % 0, 0.026 wt % N, balance Fe. Alloy 3 has a composition of 18.1 wt % La, 4.48 wt % Co, 3.74 wt % Si, 0.024 wt % C, 0.23 wt % 0, 0.025 wt % N, balance Fe.

Permanent magnets were fabricated by pressing milled powders having the overall composition of alloys 1, 2 and 3 to form a green body. The green body was heat treated at 1100° C. for 3 hours in vacuum and 1 hour in Argon, then at 1040° C. for 8 hours in Argon before being quenched at 50 K/min to room temperature.

A further annealing treatment at temperatures in the range from 650° C. to 850° C. for dwell times in the range 12 hours to 140 hours was carried out under an Argon atmosphere. The samples were quenched from the annealing temperature at 50 K/min to room temperature.

The coercivity of the samples was measured using a commercially available system known as a Koerzimat and the results are summarized in table 7.

For all of the compositions, the measured coercivity decreases with increasing annealing temperature. The highest coercivity values were measured for samples annealed at 650° C.

The results also indicate that the coercivity depends on the silicon content. For all of the annealing temperatures, the measured coercivity is larger for increasing silicon content. Alloy 3 with the highest silicon content showed the highest coercivity for all annealing temperatures investigated.

The magnetic properties of coercivity $H_{cJ}$ and remanence $B_r$ were measured for alloy 2 in a vibrating sample magnetometer and the results are summarized in table 8. These results also show that the coercivity decreases for increasing annealing temperature. However, the measured remanence is greater for annealing temperatures of 700° C., 750° C. and 800° C. than for annealing temperatures of 650° C. and 850° C.

Figure 9A:
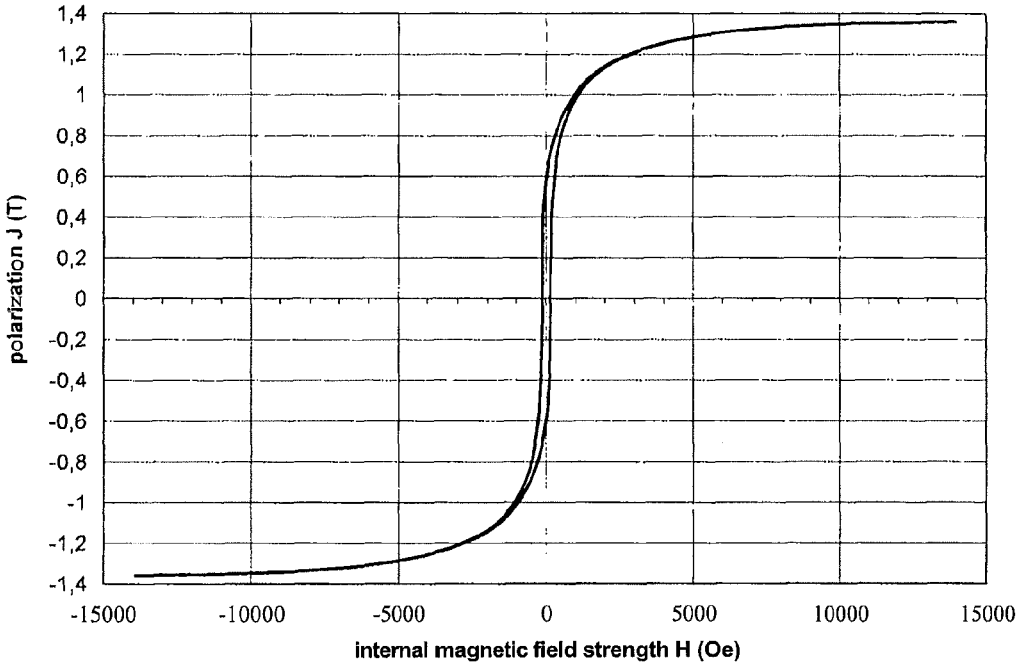
Figure 9B:
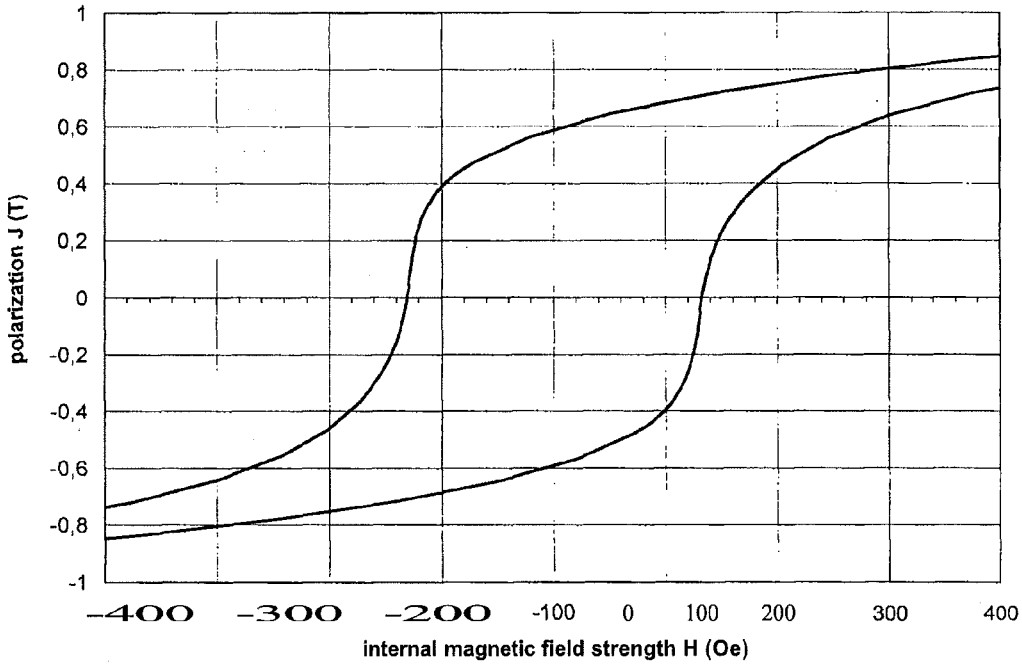

The hysteresis loop of a sample of alloy 2 annealed at 700° C. for 72 hours under argon is illustrated in FIG. 9. FIG. 9*b* illustrates the central portion of the complete hysteresis loop illustrated in FIG. 9*a*. The sample has a remanence $B_r$ of 0.565 T, a coercivity $H_{cJ}$ of 130 Oe and $(BH)_{max}$ of 0.4 MGOe and a saturation polarization of nearly 1.4 T.

Figure 10:
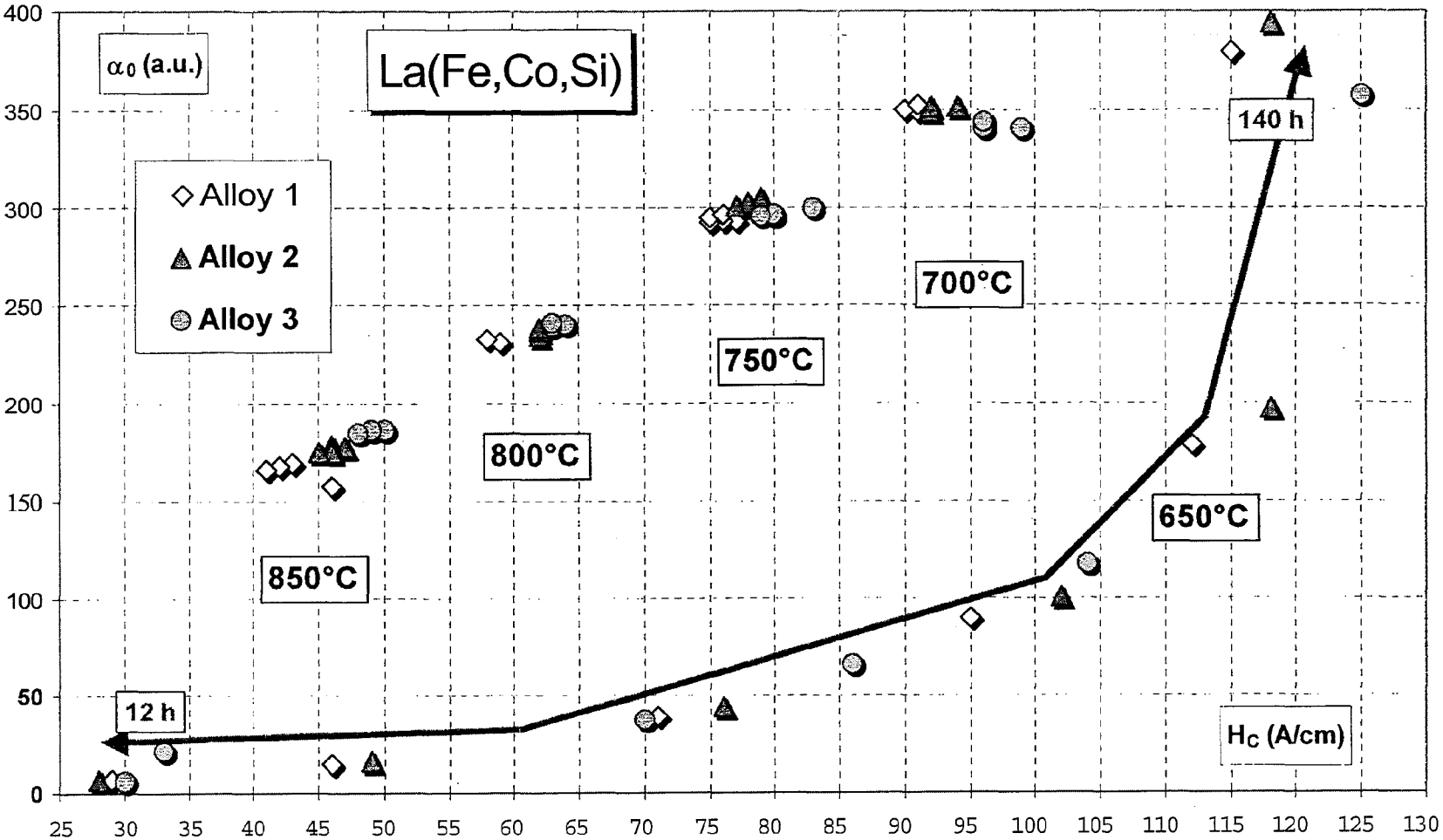
FIG. 10 is a graph that illustrates the open remanence as a function of coercivity for permanent magnets according to the fourth embodiment annealed under different conditions.

FIG. 10 illustrates the open circuit remanence in arbitrary units as a function of coercivity $H_{cJ}$ for alloys 1, 2 and 3 annealed under the conditions summarized in table 7.

The open remanence is dependent on the geometry of the sample tested. All of the samples have the same geometry so that the values of the open remanence summarized in FIG. 10 can be compared with one another although the units are arbitrary.

Four measurements are illustrated for each sample. For samples annealed at 650° C., the coercivity as well as the open remanence increases for increasing annealing time. For the other annealing temperatures, the maximum values of the open remanence and coercivity were reached after about 12 hours. Longer annealing times were observed to result in little further increase in the values of the open remanence and coercivity.

Mechanical Properties of the Permanent Magnets

The compression strength of the permanent magnets was also measured and a average compression strength of 1176.2 N/mm$^2$ and 1123.9 N/mm$^2$ measured. The elastic modulus was measured to be 168 kN/mm$^2$ and 162 kN/mm$^2$, respectively.

The permanent magnets could be worked by grinding and wire erosion cutting to produce two or more smaller permanent magnets from the as-produced larger permanent magnets. Therefore, the permanent magnets can be produced using cost-effective manufacturing techniques since large blocks can be produced and afterwards worked to produce a plurality of smaller magnets with the desired dimensions.

In an embodiment, a permanent magnet having a composition of 18.55 wt % La, 4.64 wt % Co, 3.60 wt % Si, balance iron and dimensions of 23 mm×19 mm×6.5 mm was singulated by wire erosion cutting into a plurality of pieces having dimensions of 11.5 mm×5.8 mm×0.6 mm.

In a further embodiment, a permanent magnet having a composition of 18.72 wt % La, 9.62 wt % Co, 3.27 wt % Si, balance iron and dimensions of 23 mm×19 mm×6.5 mm was singulated by wire erosion cutting into a plurality of pieces having dimensions of 11.5 mm×5.8 mm×0.6 mm.

TABLE 1

| Temperature | α-Fe content (%) measured after a dwell time of | | | |
|---|---|---|---|---|
| (° C.) | 4 hours | 16 hours | 64 hours | 88 hours |
| 850 | 48.1 | 66.1 | 65.4 | |
| 750 | 61.1 | 73.1 | 75.6 | |
| 700 | 20.8 | 71.5 | 78.3 | |
| 650 | 3.7 | 7.8 | | 74.6 |

α-Fe content for permanent magnets fabricated from precursor articles having the composition of Embodiment 2.

TABLE 2

| Temperature | α-Fe content (%) measured after a dwell time of | | | |
|---|---|---|---|---|
| (° C.) | 4 hours | 16 hours | 64 hours | 88 hours |
| 850 | 22.1 | 53.1 | 60.9 | |
| 750 | 33.9 | 59.4 | 70.0 | |
| 700 | 24.0 | 50.6 | 68.5 | |
| 650 | 6.6 | 17.2 | | 63.4 |

α-Fe content for permanent magnets fabricated from precursor articles having the composition of Embodiment 3.

TABLE 3

Curie temperature $T_c$ and composition of precursor articles used to investigate the effect of cooling rate on α-Fe content.

| Sample No. | $T_c$ (° C.) | $La_m$ (%) | $Si_m$ (%) | $Co_m$ (%) | Fe (%) |
|---|---|---|---|---|---|
| MPS1037 | −16 | 16.70 | 3.72 | 4.59 | balance |
| MPS1038 | −7 | 16.69 | 3.68 | 5.25 | balance |

TABLE 3-continued

Curie temperature $T_c$ and composition of precursor articles used to investigate the effect of cooling rate on α-Fe content.

| Sample No. | $T_c$ (° C.) | $La_m$ (%) | $Si_m$ (%) | $Co_m$ (%) | Fe (%) |
|---|---|---|---|---|---|
| MPS1039 | +3 | 16.67 | 3.64 | 5.99 | balance |
| MPS1040 | +15 | 16.66 | 3.60 | 6.88 | balance |
| MPS1041 | +29 | 16.64 | 3.54 | 7.92 | balance |
| MPS1042 | +44 | 16.62 | 3.48 | 9.03 | balance |
| MPS1043 | +59 | 16.60 | 3.42 | 10.14 | balance |

TABLE 4

α-Fe content measured after a heat treatmentat different temperatures for 4 hours, each sample having previously undergone heat treatment at all the higher temperatures above it in the table.

| Temperature (° C.) | Sample No. | | | | | |
|---|---|---|---|---|---|---|
| | MPS1037 | MPS1038 | MPS1039 | MPS1040 | MPS1042 | MPS1043 |
| Starting condition | 11.2% | 13.2% | 14.9% | 12.2% | 18.4% | 15.9% |
| 1100 | 9.3% | 9.6% | 8.5% | 8.3% | 7.5% | 7.4% |
| 1050 | 4.7% | 4.6% | 4.8% | 4.2% | 4.4% | 4.2% |
| 1000 | 4.6% | 4.4% | 4.5% | 4.1% | 5.1% | 4.8% |
| 950 | 8.0% | 8.5% | 8.9% | 8.3% | 18.1% | 15.4% |
| 900 | 14.3% | 16.9% | 18.5% | 17.7% | 34.0% | 32.1% |
| 850 | 41.7% | 45.7% | 44.6% | 41.4% | 54.1% | 52.3% |
| 800 | 60.0% | 61.6% | 57.9% | 52.5% | 63.3% | 61.8% |
| 750 | 65.6% | 66.7% | 63.8% | 60.2% | 67.8% | 66.1% |
| 700 | 66.3% | 67.2% | 66.1% | 63.2% | 70.6% | 69.5% |
| 650 | 67.2% | 68.7% | 66.6% | 64.0% | 71.5% | 67.9% |

TABLE 5

Magnetic properties measured at 20° C. for the permanent magnet of Figure 8.

| | |
|---|---|
| $B_r$ | 0.394 T |
| $H_{cB}$ | 6 kA/m |
| $H_{cJ}$ | 6 kA/m |
| $(BH)_{max}$ | 1 kJ/m$^3$ |

TABLE 6

Composition in weight percent of the alloys of embodiment 4.

| alloy | La | Fe | Co | Si | C | O | N |
|---|---|---|---|---|---|---|---|
| 1 | 18.1 | balance | 4.49 | 3.54 | 0.026 | 0.24 | 0.025 |
| 2 | 18.1 | balance | 4.48 | 3.64 | 0.025 | 0.23 | 0.026 |
| 3 | 18.1 | balance | 4.48 | 3.74 | 0.024 | 0.23 | 0.025 |

TABLE 7

Coercivity $H_{cJ}$ measured for alloys 1 to 3 annealed under different conditions.

| alloy | annealing temperature (° C.) | annealing time (h) | Coercivity $H_{cJ}$ (A/cm) |
|---|---|---|---|
| 1 | 650 | 140 | 115 |
| 2 | | | 118 |
| 3 | | | 125 |
| 1 | 700 | 72 | 91 |
| 2 | | | 92 |
| 3 | | | 96 |

TABLE 7-continued

Coercivity $H_{cJ}$ measured for alloys 1 to 3 annealed under different conditions.

| alloy | annealing temperature (° C.) | annealing time (h) | Coercivity $H_{cJ}$ (A/cm) |
|---|---|---|---|
| 1 | 750 | 76 | 76 |
| 2 | | | 77 |
| 3 | | | 79 |
| 1 | 800 | 72 | 58 |
| 2 | | | 62 |

TABLE 7-continued

Coercivity $H_{cJ}$ measured for alloys 1 to 3 annealed under different conditions.

| alloy | annealing temperature (° C.) | annealing time (h) | Coercivity $H_{cJ}$ (A/cm) |
|---|---|---|---|
| 3 | | | 63 |
| 1 | 850 | 76 | 41 |
| 2 | | | 45 |
| 3 | | | 48 |

TABLE 8

Magnetic properties of alloy 2 measured in a vibrating sample magnetometer.

| annealing temperature (° C.) | annealing time (h) | Coercivity $H_{cJ}$ A/cm | Remanenz $B_r$ (T) |
|---|---|---|---|
| 650 | 140 | 130 | 0.241 |
| 700 | 72 | 100 | 0.565 |
| 750 | 76 | 90 | 0.455 |
| 800 | 72 | 70 | 0.545 |
| 850 | 76 | 50 | 0.333 |

The invention having been thus described with reference to certain specific embodiments and examples thereof, it will be understood that this is illustrative, and not limiting, of the appended claims.

The invention claimed is:

1. Magnetic article comprising, in total, elements in amounts capable of providing at least one $(La_{1-a}M_a)(Fe_{1-b-c}$ $T_bY_c)_{13-d}X_e$ phase and less than 5 Vol % impurities, wherein $0 \leqq a \leqq 0.9$, $0 \leqq b \leqq 0.2$, $0.05 \leqq c \leqq 0.2$, $-1 \leqq d \leqq +1$, $0 \leqq e \leqq 3$, M is one or more of the elements Ce, Pr and Nd, T is one or more of the elements Co, Ni, Mn and Cr, Y is one or more of the elements Si, Al, As, Ga, Ge, Sn and Sb and X is one or more of the elements H, B, C, N, Li and Be, wherein the magnetic article comprises a permanent magnet comprising:

a non-magnetic matrix, and a plurality of permanently magnetic inclusions comprising at least one α-Fe-type phase distributed in the non-magnetic matrix.

2. The magnetic article according to claim 1, having $B_r$>0.35T and $H_{cJ}$>80 Oe.

3. The magnetic article according to claim 1, having $B_s$>1.0 T.

4. The magnetic article according to claim 1, wherein a=0, T is Co, Y is Si, and e=0.

5. The magnetic article according to claim 4, wherein $0<b \leqq 0.075$ and $0.05<c \leqq 0.1$.

6. The magnetic article according to claim 1, wherein the magnetic article comprises greater than 60 vol % of one or more α-Fe-type phases.

7. The magnetic article according to claim 1, wherein the α-Fe-type phase further comprises Co and Si.

8. The magnetic article according to claim 1, wherein the magnetic article further comprises La-rich and Si-rich phases.

9. The magnetic article according to claim 1, wherein the magnetic article comprises anisotropic magnetic properties.

10. Method of fabricating a magnetic article comprising:

providing a precursor article comprising, in total, elements in amounts capable of providing at least one $(La_{1-a}M_a)(Fe_{1-b-c}T_bY_c)_{13-d}X_e$ phase and less than 5 Vol % impurities, wherein $0 \leqq a \leqq 0.9$, $0 \leqq b \leqq 0.2$, $0.05 \leqq c \leqq 0.2$, $-1 \leqq d \leqq +1$, $0 \leqq e \leqq 3$, M is one or more of the elements Ce, Pr and Nd, T is one or more of the elements Co, Ni, Mn and Cr, Y is one or more of the elements Si, Al, As, Ga, Ge, Sn and Sb and X is one or more of the elements H, B, C, N, Li and Be, and heat treating the precursor article to produce a permanent magnet comprising permanently magnetic α-Fe-type inclusions in a non-magnetic matrix.

11. The method according to claim 10, wherein before the heat treating the precursor article comprises at least one phase with a $NaZn_{13}$-type crystal structure.

12. The method according to claim 11, wherein the heat treating of the precursor article comprises heat treating under conditions selected so as to decompose the phase with the $NaZn_{13}$-type crystal structure and form at least one permanently magnetic phase.

13. The method according to claim 10, wherein the heat treating of the precursor article comprises heat treating under conditions selected to produce an article comprising a permanently magnetic portion of at least 60 vol %.

14. The method according to claim 10, wherein the heat treating of the precursor article and/or the permanent magnet comprises heat treating whilst applying a magnetic field to produce an anisotropic permanent magnet.

15. The method according to claim 10, wherein the providing of the precursor article comprises mixing powders selected to provide, in total, elements in amounts capable of providing at least one $(La_{1-a}M_a)(Fe_{1-b-c}T_bY_c)_{13-d}X_e$ phase and sintering the powders at a temperature T1 to produce at least one phase with a $NaZn_{13}$-type crystal structure.

16. The method according to claim 15, further comprising after the heat treatment at temperature T1, heat treated the article at a temperature T2 to form at least one permanently magnetic phase, wherein T2<T1.

17. The method according to claim 16, further comprising cooling the article from T1 to T2 at a rate of greater than 2K/min or, preferably, greater than 10K/min.

18. The method according to claim 16, wherein T2 is selected so as to produce a decomposition of the phase with the $NaZn_{13}$-type crystal structure at T2.

19. The method according to claim 16, wherein the article produces a reversible decomposition of the phase with the $NaZn_{13}$-type crystal structure at T2.

* * * * *